252-99 AU 166 EX
7/18/78 XR 4,101,455

United States Patent [19]
Francis et al.
[11] 4,101,455
[45] Jul. 18, 1978

[54] LOW PHOSPHATE CONTENT GLASSY PHOSPHATE DETERGENT COMPOSITIONS HAVING OPTIMUM DETERGENCY

[75] Inventors: Edward Francis, Midland, Mich.; Craig Ronald Carson; Michael Lance McKay, both of Cincinnati, Ohio

[73] Assignee: The Procter & Gamble Company, Cincinnati, Ohio

[21] Appl. No.: 681,320

[22] Filed: Apr. 29, 1976

Related U.S. Application Data

[63] Continuation-in-part of Ser. No. 587,451, Jun. 16, 1975, abandoned, which is a continuation-in-part of Ser. No. 551,476, Feb. 20, 1975, abandoned.

[51] Int. Cl.² ..... C11D 3/06; C11D 3/065
[52] U.S. Cl. ..... 252/531; 252/99; 252/109; 252/135; 252/532; 252/539; 252/540
[58] Field of Search ..... 252/109, 110, 135, 539, 252/531, 532

[56] References Cited

U.S. PATENT DOCUMENTS

| | | | |
|---|---|---|---|
| 2,154,977 | 4/1939 | Furness | 252/135 |
| 2,382,165 | 8/1945 | MacMahon | 252/531 |
| 2,897,155 | 7/1959 | McNaught | 252/109 |
| 3,001,945 | 9/1961 | Drew | 252/547 |
| 3,127,238 | 3/1964 | Fuchs | 423/305 |
| 3,198,740 | 8/1965 | Dunlop | 252/190 |
| 3,579,455 | 5/1971 | Sabatelli | 252/135 |
| 3,844,951 | 10/1974 | Fries | 252/8.6 |
| 3,896,056 | 7/1975 | Benjamin | 252/539 |

*Primary Examiner*—Dennis L. Albrecht
*Attorney, Agent, or Firm*—Richard C. Witte; Thomas H. O'Flaherty; Robert B. Aylor

[57] ABSTRACT

An improved low phosphate content detergent composition comprising about 5 to about 35% by weight of a mixture of orthophosphate and pyrophosphate builder salts having a weight ratio of 1:1 to 1:200; from 0 to about 30% of a tripolyphosphate builder salt; from 3 to 30% of an organic water-soluble synthetic detergent selected from the group consisting of anionic, nonionic, zwitterionic, and ampholytic detergents; and from about 0.1% to about 4% of a glassy phosphate.

3 Claims, 1 Drawing Figure

WHITENESS MAINTENANCE TEST RESULTS USING COTTON TERRY CLOTHS
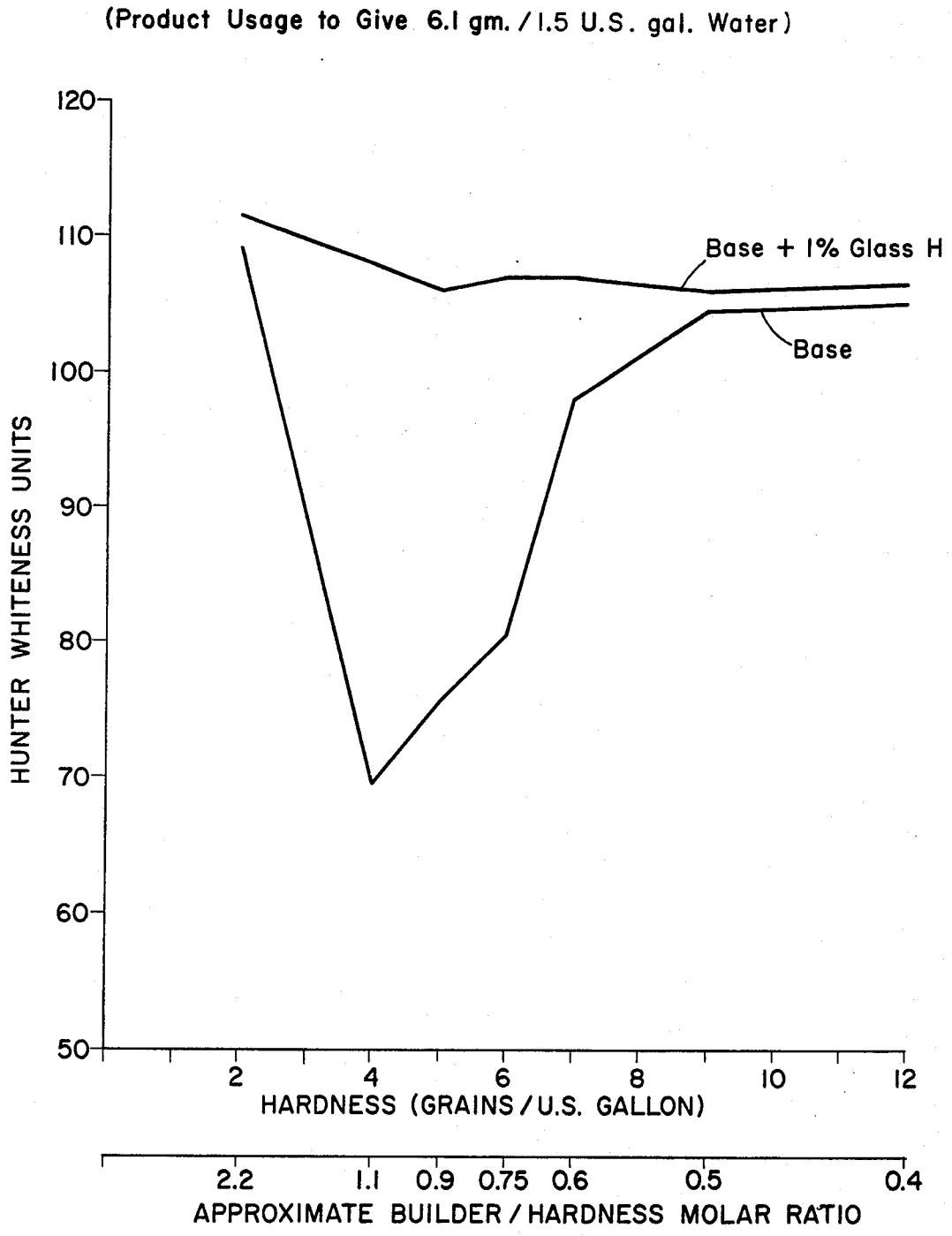

LOW PHOSPHATE CONTENT GLASSY PHOSPHATE DETERGENT COMPOSITIONS HAVING OPTIMUM DETERGENCY

CROSS-REFERENCE TO RELATED APPLICATION

This application is a continuation-in-part application of copending U.S. patent application Ser. No. 587,451 filed June 16, 1975 now abandoned, which is a continuation-in-part of U.S. patent application Ser. No. 551,476 filed Feb. 20, 1975 (now abandoned).

BACKGROUND OF THE INVENTION

This invention concerns detergent compositions comprising mixtures of orthophosphate and pyrophosphate builder salts and low levels of glassy phosphates.

The use of glassy phosphates with other phosphate builders in detergent compositions is known in the art. For example, mechanical dishwashing compositions incorporating sodium hexametaphosphate are disclosed in U.S. Pat. No. 3,579,455 to Phillip M. Sabatelli et al, issued May 18, 1971. Detergent compositions incorporating glassy phosphates are also disclosed in U.S. Pat. No. 2,568,110 to Irving Beiley et al., issued Sept. 18, 1951. Glassy phosphates have also been known for years as adjuvants in soap and detergent compositions. They are described in U.S. Pat. No. 1,956,515 to Ralph E. Hall, April, 1934, (herein incorporated by reference) and U.S. Pat. No. 2,568,110 to Irving Beiley et al., Sept. 18, 1951, (herein incorporated by reference) and in *General and Inorganic Chemistry,* J. R. Partington, 4th Edition, MacMillan, 1967, (herein incorporated by reference). However, the prior art does not appear to have recognized the benefit attainable by the use of small amounts of glassy phosphates in conjunction with levels of conventional phosphate builders that are insufficient to provide optimum detergency at the levels of mineral hardness ion encountered in a typical U.S. laundering operation.

Detergency is a complex phenomenon believed to involve very many factors such as cleaning ability, i.e., the ability to remove soil from fabric; and whiteness maintenance, i.e., the ability of the detergent solution to prevent suspended soil from depositing on the fabric. In built detergent systems builders are thought to be beneficial influences on factors such as stabilization of suspended solid soils, emulsification of soils, the surface activity of the aqueous detergent solution, the solubilization of water-insoluble materials, the foam or suds-producing characteristics of the washing solution, peptization of soil agglomerates, neutralization of acid soils, and the like, in addition to the sequestration of mineral constituents present in the washing solution. The action of different builders varies, and no general basis has been found either in physical properties or in chemical structure upon which one can predict in advance the excellence, ranking, or performance of chemical materials or mixtures thereof as detergency builders.

Various inorganic salts such as alkali metal carbonates, bicarbonates, borates, phosphates, and silicates are known to display builder effects. The best of the inorganic builders are the water-soluble polyphosphates and in particular the water-soluble pyrophosphates and tripolyphosphates. Of these, sodium tripolyphosphate (STP) is the builder most generally used in solid detergent compositions. However, STP reverts or hydrolyzes during the crutching and spray-drying processing steps of making detergent products, forming some pyrophosphate and some orthophosphate, the latter being a less efficient builder and having among other disadvantages a detrimental effect on the softness of the fabrics being washed. In fully built solid detergent compositions, the hydrolysis of some of the STP is compensated for by raising the level of STP in the product. There has, however, been a recent tendency for phosphate builders to be reduced or eliminated from detergent compositions because of the ability of these materials to act as a nutrient in promoting the undesirable growth of algae in rivers and lakes. Moreover, a significant drawback in the elimination or reduction of tripolyphosphate builders from detergent products is, as alluded to above, a corresponding decrease in whiteness maintenance.

Water-soluble pyrophosphates are also effective detergent builders when utilized alone or with the tripolyphosphates. Pyrophosphate products in which no tripolyphosphate is present contain small levels of orthophosphates, which are present as impurities in the pyrophosphate as obtained from the supplier. Pure pyrophosphate products ordinarily contain from about 0.5% to 5% of orthophosphate by weight of the pyrophosphate. "Pure" pyrophosphate products indicate that the product formulation is intended to contain pyrophosphate as the only phosphate species, but which on a commercial scale contain other species of phosphates. The "pure" pyrophosphate built products are particularly sensitive to whiteness maintenance problems because of the lack of tripolyphosphates which provide a slight whiteness maintenance benefit.

Particulate soil redeposition is most evident in laundry wash solutions containing phosphate builders when the molar ratio of builder to mineral hardness ion is in a range that is slightly less than 1:1. The redeposition is particularly severe when mixtures of pyrophosphates and orthophosphate are present, such mixtures commonly occurring as a result of the reversion of sodium tripolyphosphate during crutching and spray drying of detergent compositions. This particular redeposition problem is referred to hereinafter as the "pyro-dip" because of the decrease in whiteness maintenance performance that is observed if fabric laundering is carried out under these conditions.

It has also been observed that detergent compositions formulated in accordance with the present invention enjoy the added benefit due to the incorporation of the glassy phosphate of reducing deposition not only upon the fabrics but also of the builder salts and surfactants upon exposed machine surfaces. For instance, it has been observed in sodium tripolyphosphate products which contain substantial amounts of reverted pyrophosphate and orthophosphate, that deposition upon the machine surfaces can be a significant problem. This is most often discovered by the consumer when the washing machine drum is removed for repair. While there is no buildup on the inner surface of the tub where the fabrics are constantly abrading, the buildup on the outer surface of the washing machine drum of surfactant and phosphate salts can be severe. In particular, the salts of organic sulfuric and sulfonic acids (surfactants, have been observed as deposits on washing machine surfaces.

Accordingly, a primary object of the invention is the attainment of satisfactory detergency performance with compositions in which the level of phosphate builders is less than that necessary to sequester all of the mineral hardness present under normal usage conditions.

A further object of the invention is the provision of an optimum builder mixture having detergency building properties substantially greater than the additive contributions of the components thereof.

A further object of the present invention is to provide for phosphate built detergent compositions in which insoluble surfactant and insoluble phosphate salt buildup upon machine surfaces is reduced.

It is also an object of the invention to provide detergent compositions which are effective in water solutions over a wide range of concentrations inasmuch as the conditions under which household laundry is washed vary quite widely with the individual. Throughout the specification and claims, percentages and ratios are by weight and temperatures in degrees Fahrenheit unless otherwise indicated.

SUMMARY OF THE INVENTION

According to this invention, optimum building action is displayed by a detergent composition comprising (a) from about 0.1% to about 4.0% of a glassy phosphate having the general formula $$(M_2O)_x(P_2O_5)_y$$

wherein M is an alkali metal, preferably sodium or potassium; $y$ has a value in the range of about 5 to 50; and the ratio of $y$:$x$ is from about 1:1 to about 1:1.5; (b) from about 5% to about 35% of a mixture of pyrophosphate and orthophosphate builder salts having a ratio in the range of about 1:1 to 200:1; (c) from 0% to about 30% of a tripolyphosphate builder salt, preferably sodium tripolyphosphate; (d) from about 3% to 30% of an organic water-soluble surface-active agent selected from the group consisting of anionic, nonionic, zwitterionic, and ampholytic surfactants; and (e) from 0% to about 60% of a detergency builder selected from the group consisting of water-soluble salts of carbonates, bicarbonates, sesquicarbonates, nitrilotriacetates, silicates, and organic phosphates; wherein a total amount of the said phosphate builder salts is from about 5% to about 35% by weight of said detergent composition.

DESCRIPTION OF THE DRAWING

The figure constitutes a plot of the whiteness maintenance results for cotton terry cloths washed in two compositions (one containing a glassy phosphate) as a function of the mineral hardness level in the wash solution. The whiteness maintenance results are expressed as Hunter Whiteness Units and the hardness (3/1 Ca/Mg) is given in grains per U.S. gallon as $CaCO_3$; A corresponding plot of the builder to hardness molar ratio is also given. The base formula represented in the drawing is that described at page 29.

DESCRIPTION OF THE INVENTION

The detergent compositions of the present invention consist essentially of a glassy polymeric phosphate, an orthophosphate-pyrophosphate detergency builder mixture, and a watersoluble organic surfactant.

Not all of the known glassy phosphates are of value for the purposes of the present invention. It has been found that where the phosphate molecule contains less than about 10 phosphorus atoms, the benefits provided are too small to be measurable. Thus, the glassy phosphates useful in the present invention have a general formula of $$(M_2O)_x(P_2O_5)_y$$

wherein M is an alkali metal, $y$ has a value in the range of 5 to 50, preferably 7 to 12 and the ratio of $y$:$x$ is from about 1:1 to about 1:1.5.

Preferably the glassy phosphates have the formula $M_{2y+2}P_{2y}O_{6y+1}$ wherein $y$ is defined as above, most preferably with values of where there are 14 and 21 phosphorous atoms in the molecule.

The following experiment illustrates the efficacy of various glassy phosphates for the purposes of the present invention. Five detergent products were made up having the compositions below.

| | 1 | 2 | 3 | 4 | 5 |
|---|---|---|---|---|---|
| Anionic surfactant* | 18.0 | 18.0 | 18.0 | 18.0 | 18.0 |
| Sodium tripolyphosphate | 25.6 | 25.2 | 24.8 | 24.6 | 24.4 |
| Sodium silicate ($SiO_2$:$Na_2O$ = 2.4:1) | 12.0 | 12.0 | 12.0 | 12.0 | 12.0 |
| Sodium sulfate | 37.0 | 37.0 | 37.0 | 37.0 | 37.0 |
| Miscellaneous | 1.4 | 1.8 | 2.2 | 2.4 | 2.6 |
| Moisture | 6.0 | 6.0 | 6.0 | 6.0 | 6.0 |
| | 100.0 | 100.0 | 100.0 | 100.0 | 100.0 |

*comprising 7% $C_{11.8}$ linear alkyl benzene sulfonate and 5.5% $C_{12}$—$C_{16}$ alkyl triethyoxy ether sulfate 5.5% $C_{14}$—$C_{18}$ alkyl sulfate.

1% of a glassy polymeric phosphate was added to each of Products 2–5 inclusive as follows:

| 2 | 3 | 4 | 5 |
|---|---|---|---|
| $[NaPO_3]_6$ | $[NaPO_3]_{10}$ | $[NaPO_3]_{14}$ | $[NaPO_3]_{21}$ |

Each product was then employed at 1 cup usage in 100° F water of 4. 5.5, and 7 grains mineral hardness (Ca:Mg = 3:1) to give a 10 minute wash to 3 clean cotton terry cloths. Included in each wash were 3 cotton muslin swatches soiled with clay in order to test the ability of the various products to inhibit clay deposition from solution onto the clean terry cloths. After washing, the originally clean terry cloths were squeezed to get rid of excess moisture, dried in an electrically heated air dryer and then a Hunter Color difference meter was used to measure their whiteness. The whiteness is calculated from a composite of the "L", "*a*", "*b*" readings yielding a Hunter whiteness value. The values are shown below, the identifying numbers corresponding to the products previously tested.

| Water Hardness Grains/U.S. Gal. | 1 | 2 | 3 | 4 | 5 | LSD |
|---|---|---|---|---|---|---|
| 4.0 | 111.6 | 109.8 | 108.6 | 109.1 | 109.1 | 2.0 |
| 5.5 | 79.8 | 86.5 | 103.5 | 103.3 | 105.4 | 4.2 |
| 7.0 | 89.3 | 91.7 | 94.6 | 103.9 | 101.3 | 3.2 |

It can be seen that in water of 4 grains/gallon of mineral hardness where the compositions are fully built, little or no difference exists between any of the compositions. However, for wash water of 5.5 grains hardness, and even more noticeably in wash water of 7 grains hardness, the whiteness maintenance performance of compositions with no glassy phosphate was significantly lower. In fact, for water of 7 grains hardness a good performance was only obtained with glassy phosphate polymers containing 14 phosphorus atoms or more. Additional work has shown that the performance break point actually occurs with polymers of approximately 10 phosphorus atoms in water of 7 grains mineral hardness per gallon.

The difference in whiteness maintenance is emphasized where the initially clean swatches are washed several times in the presence of soiled swatches. Thus, while a clean test swatch may never have come in contact with the soil outside the wash solution, the contact in the wash solution over several cycles builds up the soil on the cloth thus lowering the whiteness maintenance.

The glassy phosphates are commercially available as dry powder, fine granules, plates, and coarse granules. For example, Hexaphos® and Glass H® are brands of phosphate glasses manufactured by the FMC Corporation in New York City, N.Y. These glassy phosphates have approximately 13 and 21 phosphorus atoms respectively. Glass H® is the preferred of these glassy phosphates. Polyphosphates which have the empirical formulae $Na_{16}P_{14}O_{43}$ and $Na_{12}P_{10}O_{31}$ are sold by the Hooker Chemical Corporation, Niagara Falls, New York. The level of glassy phosphates found to be useful in compositions of the present invention lies in the range of about 0.1 to about 4% by weight of the composition, preferably about 0.5 to about 2.5%, and most preferably about 1 to about 2% by weight.

The pyrophosphate builders useful in the invention are of formula $M_4P_2O_7$ where M can be hydrogen, alkali metal, ammonium or substituted ammonium, at least one and preferably at least three of the M groups being other than hydrogen. Sodium and potassium are preferred cation species especially The orthophosphate builders useful in the invention are of formula $M_3PO_4$ wherein M is defined as above and wherein at least one and preferably at least two of the M groups are other than hydrogen. The orthophosphate-pyrophosphate ratio in the combination may vary between 1:1 and 1:200, preferably between 1:1 and 1:25, and most preferably between 1:3 and 1:10 by weight.

A preferred source of the pyrophosphate-orthophosphate builder combination is tripolyphosphate which partially reverts to mixtures of pyro- and orthophosphate during processing. In addition, alkali metal, (preferably sodium), ammonium, and alkanol ammonium tripolyphosphate can constitute a supplemental phosphate builder in an amount not exceeding 30%, preferably about 5 to about 25%, by weight of the composition. However, the total percentage of phosphate species in the composition should not exceed 35% by weight.

Detergent compositions of this invention contain from 5 to 35%, preferably from 15 to 28%, most preferably from 22 to 28% by weight of the composition of the phosphate builder salt. Mixtures of phosphates can be used provided that the total phosphate level does not exceed 35% by weight of the composition. Detergent compositions in which the only builder is a phosphate at a level below 10% are usually unsatisfactory because of the poor cleaning performance obtained therefrom. A detergent composition containing less than 20% phosphate is considered to be underbuilt under normal usage conditions as this provides a ratio of builder to hardness mineral ions of less than 1. The effect of this deficiency is illustrated in the drawing wherein the bottom curve representing an underbuilt situation illustrates the so-called "pyro-dip" in whiteness maintenance. Of course, if substantially large amounts of the detergent composition are added to the wash water, a builder to hardness mineral ion ratio of greater than 1 could be obtained. The performance of a similar composition formulated in accordance with the invention so as to incorporate 1% of Glass H is represented by the top curve of the drawing. It can be seen that the latter compositions are effective under conditions such that the builder to hardness ratio is less than 1.

A mixture of pyrophosphate and orthophosphate builder salts are essential components of the present invention. The term essential indicates that orthophosphate is present as a component, from reversion or from supply contamination.

Other inorganic as well as organic builders can be included in the detergent compositions of this invention. Suitable examples of builders include the alkali metal, ammonium and substituted ammonium polyphosphates. The polyphosphonates include the sodium and potassium salts of ethylene diphosphonic acid, the sodium and potassium salts of ethane 1-hydroxy-1, 1-diphosphonic acid and the sodium and potassium salts of ethane-1,1,2-triphosphonic acid. Other examples include the water-soluble (sodium, potassium, ammonium, and substituted ammonium, e.g., mono-, di-, and triethanolammonium) salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid.

The third essential component of compositions of the present invention is an organic surfactant which may be anionic, nonionic, ampholytic, or zwitterionic in character. Surfactants of this type are disclosed in U.S. Pat. No. 3,579,454 issued to Everett J. Collier on May 18, 1971, at Column 11, line 57 to Column 13, line 64, this disclosure being specifically incorporated herein by reference.

Preferred surfactants of the examples disclosed above, are those which are insensitive to hardness mineral ions. As used herein "hardness mineral ion insensitive" indicates that the detergency of the detergent is not substantially affected by the presence of hardness mineral ions, especially calcium and magnesium. A simple test to determine whether a detergent is hardness mineral ion insensitive can be employed. A detergent is added in a stoichiometric amount (based on the hardness mineral ions) to water having a hardness equivalent to 1 mole per liter expressed as $CaCO_3$. If a precipitate visible to the naked eye does not form, the detergent is considered to be hardness mineral ion insensitive.

Examples of suitable hardness mineral ion insensitive detergents are found in the immediately following paragraphs.

Anionic organic detergents useful herein include alkali metal, ammonium and substituted-ammonium salts of esters of α-sulfonated fatty acids in which the esters contain 15 to 25 carbon atoms. These detergent compounds have the following structure:

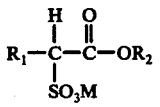

wherein $R_1$ is alkyl or alkenyl of 6 to 20 carbon atoms (adding to the two carbon atoms of structure above); $R_2$ is alkyl of 1 to 10 carbon atoms; and M is a salt-forming cation. The salt-forming cation is a water-solubilizing cation and can be, for example, an alkali metal, ammonium, or substituted-ammonium. Specific examples of substituted ammonium cations include methyl-, dimethyl-, and trimethylammonium cations and quaternary ammonium cations such as tetramethylammonium and dimethyl piperdinium cations and those derived from alkylamines such as ethylamine, diethylamine, triethylamine, mixtures thereof, and the like.

Specific examples of this class of compounds include the sodium and potassium salts of esters where $R_2$ is selected from methyl, ethyl, propyl, butyl, hexyl, and octyl groups and the fatty acid group ($R_1$ plus the two carbon atoms in the structure above) is selected from lauric, myristic, palmitic, stearic, palmitoleic, oleic, linoleic acids, and mixtures thereof. A preferred ester material is the sodium salt of the methyl ester of α-sulfonated tallow fatty acid, the term tallow indicating a carbon chain distribution approximately as follows: $C_{14}$ — 2.5%, $C_{16}$ — 28%, $C_{18}$ — 23%, palmitoleic — 2%, oleic — 41.5%, and linoleic — 3% wherein the first three fatty acids listed are saturated.

Other examples of suitable salts of α-sulfonated fatty esters useful herein include the ammonium and tetramethylammonium salts of the hexyl, octyl, ethyl, and butyl esters of α-sulfonated tridecanoic acid; the potassium and sodium salts of the ethyl, butyl, hexyl, octyl, and decyl esters of α-sulfonated pentadecanoic acid; and the sodium and potassium salts of butyl, hexyl, octyl, and decyl esters of α-sulfonated heptadecanoic acid; and the lithium and ammonium salts of butyl, hexyl, octyl, and decyl esters of α-sulfonated nonadecanoic acid.

The salts of α-sulfonated fatty acid esters of the present invention are known compounds and are described in U.S. Pat. No. 3,223,645.

Another class of suitable anionic organic detergents useful in the present invention includes salts of 2-acyloxy-alkane-1-sulfonic acids. These salts have the formula

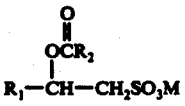

where $R_1$ is alkyl of 9 to 23 carbon atoms (adding to the two carbon atoms of the structure); $R_2$ is alkyl of 1 to 8 carbon atoms; and M is a salt-forming cation as hereinbefore described.

Specific examples of 2-acyloxy-alkane-1-sulfonates utilizable herein to provide excellent cleaning levels under household washing conditions include the sodium salt of 2-acetoxy-tridecane-1-sulfonic acid; the potassium salt of 2-propionyloxy-tetradecane-1-sulfonic acid; the lithium salt of 2-butanoyloxy-tetradecane-1-sulfonic acid; the sodium salt of 2-pentanoyloxy-pentadecane-1-sulfonic acid; the ammonium salt of 2-hexanoyloxy-hexadecane-1-sulfonic acid; the sodium salt of 2-acetoxy-hexadecane-1-sulfonic acid; the dimethylammonium salt of 2-heptanoyloxy-tridecane-1-sulfonic acid; the potassium salt of 2-octanoyloxy-tetradecane-1-sulfonic acid; the dimethylpiperdinium salt of 2-nonanoyloxytetradecane-1-sulfonic acid; the sodium salt of 2-acetoxyheptadecane-1-sulfonic acid; the lithium salt of 2-acetoxyoctadecane-1-sulfonic acid; the dimethylamine salt of 2-acetoxyoctadecane-1-sulfonic acid; the potassium salt of 2-acetoxy-nonadecane-1-sulfonic acid; the sodium salt of 2-acetoxy-uncosane-1-sulfonic acid; the sodium salt of 2-propionyloxy-docosane-1-sulfonic acid; the isomers thereof.

Preferred 2-acyloxy-alkane-1-sulfonate salts are the alkali metal salts of 2-acetoxy-alkane-1-sulfonic acids corresponding to the above formula wherein $R_1$ is an alkyl of 14 to 18 carbon atoms.

Typical examples of the above-described 2-acetoxy alkanesulfonates are described in Belgian Pat. No. 650,323 which discloses the preparation of certain 2-acyloxy alkanesulfonic acids. Similarly, U.S. Pat. Nos. 2,094,451 and 2,086,215 disclose certain salts of 2-acetoxy alkanesulfonic acids.

Other synthetic anionic detergents useful herein are alkyl ether sulfates. These materials have the formula $RO(C_2H_4O)_xSO_3M$ wherein R is alkyl or alkenyl of 10 to 20 carbon atoms, $x$ is 1 to 30, and M is a salt-forming cation defined thereinbefore. These alkyl ether sulfates, which are known compounds and which are described in U.S. Pat. No. 3,332,876 are condensation products of ethylene oxide and monohydric alcohols having 10 to 20 carbon atoms, preferably 14 to 18 carbon atoms. The alcohols can be derived from natural fats, such as coconut or tallow, or can be synthetic. Lauryl alcohol and straight chain alcohols derived from tallow are preferred herein. Such alcohols are reacted with 1 to 30, preferably 3 to 6, molar proportions of ethylene oxide and the resulting mixture of molecular species having an average of 3 to 6 moles of ethylene oxide per mole of alcohol, is sulfated and neutralized.

Specific examples of alkyl ether sulfates of the present invention are sodium coconut alkyl ethylene glycol ether sulfate; sodium tallow alkyl triethylene glycol ether sulfate; lithium tallow alkyl triethylene glycol ether sulfate; sodium tallow alkyl hexaoxyethylene sulfate; and ammonium tetradecyl octaoxyethylene sulfate.

Preferred herein for reasons of excellent cleaning properties and ready availability are the alkali metal coconutand tallow-alkyl oxyethylene ether sulfates having an average of 1 to 4 oxyethylene moieties.

A preferred class of anionic organic detergents are the 2-alkyloxy alkane sulfonates. These compounds have the following formula:

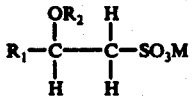

where $R_1$ is a straight chain alkyl group having from 6 to 20 carbon atoms, $R_2$ is a lower alkyl group having from 1 to 3 carbon atoms, and M is a salt-forming radical hereinbefore described.

Specific examples of 2-alkyloxy-alkane-1-sulfonates utilizable herein include potassium 2-methoxydecanesulfonate, sodium 2-methoxy-tridecanesulfonate, potassium 2-ethoxytetradecylsulfonate, sodium 2-isopropoxyhexadecylsulfonate, lithium 2-butoxytetradecylsulfonate, sodium 2-methoxyoctadecylsulfonate, and ammonium 2-propoxydodecylsulfonate.

Other suitable anionic detergents utilizable herein are olefin sulfonates having 12 to 24 carbon atoms. The term "olefin sulfonates" is used herein to mean compounds which are produced by the sulfonation of α-olefin by means of uncomplexed sulfur trioxide followed by neutralization of the acid reaction mixture under conditions such that sultones formed in the reaction and hydrolyzed to give corresponding hydroxyalkanesulfonates. The sulfur trioxide may be liquid or gaseous, and is usually, but not necessarily, diluted by inert diluents, for example by liquid $SO_2$, chlorinated hydrocarbon, etc., when used in the liquid form, or by air, nitrogen, gaseous $SO_2$, etc., when used in the gaseous form. The α-olefins from which the olefin sulfonates are derived are mono-olefins having 12 to 24 carbon atoms, preferably 14 to 16 carbon atoms. Preferably, they are straight chain olefins. Examples of suitable 1-olefins include 1-dodecene, 1-tetradecene, 1-hexadecene, 1-octadecene, 1-eicosene, and 1-tetracosene.

In addition to the true alkene sulfonates and a proportion of hydroxyalkanesulfonates, the olefin sulfonates can contain minor amounts of other materials, such as alkene disulfonates, depending upon the reaction conditions, proportions of reactants, the nature of the starting olefins and impurities in the olefin stock and side reactions during the sulfonation process.

Any of several known nonionic surfactants may be used herein inasmuch as all such surfactants are hardness mineral ion insensitive. The previously cited U.S. Pat. No. 3,579,454 discloses examples of nonionic surfactants of particular interest.

The amount of detergent employed in the compositions of this invention is from about 3 to about 30% of the total composition, preferably from about 5 to about 25% and most preferably from about 10 to about 20%.

Although mineral hardness ion insensitive surfactants are preferred, a surfactant considered to be hardness mineral ion sensitive may be mixed with the above-discussed detergents. Generally, a weight ratio of sensitive to insensitive detergent is at most 4:1, preferably at most 3:1. Any of several known water-soluble organic hardness mineral ion sensitive detergents may be used herein. A particularly preferred detergent mixture is a mixture of a water-soluble salt of linear alkylbenzene sulfonate wherein the alkyl radical contains from 10 to 15 carbon atoms and a condensation product of an alcohol having 8 to 18 carbon atoms with from 3 to 15 moles of ethylene oxide per mole of alcohol in a weight ratio of from 3:1 to 1:1.

In addition to the above essential components, the composition of this invention may include other optional detergent composition ingredients. For example, the compositions can contain major amounts of additional detergent composition ingredients such as non-phosphorus-containing detergent builder salts in amounts of up to 60%, preferably 20 to 55% by weight of the compositions. Preferably, the compositions of this invention contain from 30 to 45% of organic and/or inorganic salts selected from the group consisting of alkali metal carbonates, alkali metal bicarbonates, alkali metal silicates having a $SiO_2$:$Na_2O$ ratio of from 4:1 to 1.5:1, alkali metal and alkali earth metal carboxylates, sulfates, and chlorides. Most preferably from 1% to 15% sodium silicate having a $SiO_2$:$Na_2O$ ratio of from 3:1 to 1.5:1, and 5 to 40% sodium sulfate are included in the compositions of this invention.

Optional ingredients that may also be incorporated in detergent compositions of the present invention include enzymes for removal of protein-based or carbohydrate-based stains. Enzymes for removing protein-based stains are proteolytic in nature such as those sold under the trade names "Alcalase" and "Esterase" by Novo Industries A/S Denmark or under the trade names "Maxatase" and "AZ Protease" by Gist-Brocades N.V. The Netherlands. These materials are normally incorporated at levels of up to 1% by weight, preferably 0.25 to 0.75% by weight, and are preferably coated or prilled with inert additives to minimize dust formation and improve storage stability. A wide range of enzyme materials and means for their incorporation into synthetic detergent granules is disclosed in U.S. Pat. No. 3,553,139 issued on Jan. 5, 1971, to MeCarty, Roald, DeOude, Blomeyer, and Cracco, which disclosure is hereby incorporated by reference.

A further ingredient that may be incorporated to improve product performance is a bleaching agent of the halogen or oxygen-containing type. Examples of the hypohalite bleach type include trichloroisocyanuric acid and the sodium and potassium dichloroisocyanurates and N-chloro and N-bromo alkane sulfonamides. Such materials are normally added at 0.5 to 10% by weight of the finished product, preferably 1 to 5% by weight.

Examples of oxygen-containing bleaches include sodium perborate, sodium percarbonate, and potassium monopersulfate that are incorporated at levels of 5 to 30%, preferably 10 to 25% by weight of the final product. The inclusion of organic bleach activators such as phthalic anhydride, tetra acetyl ethylene diamine, tetra acetyl methylene diamine, or tetra acetyl glycouril lead to the in situ production during the washing process of the corresponding organic peroxy acids which have enhanced low temperature bleaching performance. Activators of this type are normally used with sodium perborate, at usage levels of 5 to 15% by weight of the final product.

Materials to boost or modify the subsing pattern of the compositions of the present invention may also be included. Examples of suds boosters include coconut and tallow monoand di-alkanolamides, particularly ethanolamides and $C_{12-15}$ alkyl di-lower alkyl amine oxides. Typical suds depressors include long chain fatty acids such as those disclosed in U.S. Pat. No. 2,954,347 issued Sept. 27, 1960, to Wayne St. John and combinations of certain nonionics therewith as disclosed in U.S. Pat. No. 2,954,348 issued Sept. 27, 1960, to Eugene Schwoeppe, both disclosures being incorporated herein by reference.

Other optional ingredients in granular products include hydrotropes and anticaking additives such as salts of lower alkyl-aryl sulfonic acids, salts of α-sulfosuccinic acid, and α-sulfobenzoic acid, and urea, normally utilized at levels of 0.5 to 5% by weight of the final product, preferably at levels of 1 to 3% by weight. $C_{12}$–$C_{18}$ alkyl acid phosphates and their condensation products with ethylene oxide may also be incorporated at similar levels for control of crutcher mix viscosity. Antiredeposition agents such as carboxymethyl cellulose, hydroxyethyl cellulose, and their derivatives may also be incorporated.

Advantageously, ingredients may also be included to minimize the wrinkling of fabrics that occurs during conventional drying processes. Detergent products incorporating starch and other particulate materials useful as fabric conditioning agents are disclosed in Belgian Pat. No. 811,082 published Aug. 16, 1974, and incorporated herein by reference. A non-limiting example of such a fabric conditioning agent is corn starch, which can be added at a level of 0.1 to 5.0% by weight of the composition, preferably 0.25 to 1.0%.

Anti-tarnish and anti-corrosion agents, perfume and color may also be included, the last ingredient being conveniently added either as a general color or in the form of a speckle applied to a separate granule fraction of the entire formulation or to a granulate of one or more of the ingredients.

The pH of detergent formulations in accordance with the present invention can lie anywhere within the range of 5 to 12, but is preferably chosen to fall within the range of 8 to 10.5, as this provides a slight particulate soil removal benefit on synthetic fabrics. However, the use of specific optional components such as enzymes may require the selection of a product pH that will permit optimum functioning of the component concerned.

The compositions of the present invention are particulate in nature and can be made in a number of ways known in the art, e.g., by forming a slurry and spray drying, by granulation in a rotating drum or pan, or by dry mixing. If spray drying or granulation processes are employed, care must be taken to avoid exposing the glassy phosphate to moisture and/or heat that could result in premature decomposition of the glassy phosphate to give less desirable species. Accordingly, dry mix addition of the glassy phosphate to the base detergent material is employed or alternatively a spray-on technique can be used in which the glassy phosphate is applied as a slurry in a fluid non-aqueous medium. A highly preferred technique is the use of a molten non-aqueous organic material in which the glassy phosphate is slurried and they sprayed onto the base granules. Polyethylene glycol of molecular weight 4000 to 6000 is the most preferred medium, although other materials such as $C_{16}$–$C_{30}$ fatty alcohols, $C_{12}$–$C_{30}$ fatty acids, and certain amides such as propyl amide, and $C_{10}$–$C_{15}$ N-methyl amides can also be used. Protected glassy phosphates and detergent compositions incorporating them are the subject of the commonly assigned application Ser. No. 551,476, filed Feb. 20, 1975, entitled "Protected Glassy Phosphate Detergent Additive" (Inventor, W. R. Ashcraft), the disclosures of which are incorporated herein by reference.

The following examples merely serve to illustrate the invention and are not intended to be restrictive thereof. All parts, percentages, and ratios set forth herein, in the preceding specification, and in the appended claims are by weight unless otherwise indicated.

EXAMPLE I

A Base detergent formulation was made comprising:

| Ingredient | Parts by Weight |
|---|---|
| Ethoxylated coconut alcohol[a] | 4.5 |
| Sodium linear alkyl benzene sulfonate with an average alkyl chain of 11.8 | 16.0 |
| Sodium silicate having an $SiO_2$:$Na_2O$ ratio of 2:1 | 12.0 |
| Sodium sulfate | 40.0 |
| Water | 2.5 |
| Fabric fluorescers | 0.6 |
| "Hole" for phosphate species | 24.4 |

[a]$C_{12-13}$ 8E (average)

The ability of low levels of glassy polyphosphate to greatly reduce or eliminate the "pyro-dip" was evaluated in the following manner:

Laboratory screening studies were conducted using an "Ultra-Marine Blue Deposition" (UMBD) test. [UMB is particularly useful as a "pyro-dip" indicator because of its blue color and its particulate, clay-like nature.] The test method consisted of washing three white cotton terry washcloths in an automatic, miniature washer at 100° F for two 10 minute cycles at various water hardness conditions using a solution that contained the test detergent composition plus approximately 0.5% ultramarine blue (UMB) pigment.

The test builder systems to be evaluated were added as dry materials to the Base detergent formulation and were then dissolved in an amount of 6.8 grams/1.5 gallons of water (equivalent to 1 cup/17 gal. water). The UMB was added in a liquid suspension. After being washed, the cotton terries were dried, and their degree of blueing deposition was measured in a conventional manner employing a Hunter Color Difference Meter from Hunter Associates Laboratory, Fairfax, Va. This device operates on the principle of reflectance and, by reading the "*b*" value on the meter, measures the degree of blueness. The more negative the "*b*" reading, the greater the degree of blueness or pyro-UMB deposition. The effect of the presence of glassy polyphosphate on the "pyro-dip" was determined by comparing the "*b*" value resulting therefrom with that resulting from the non-glassy polyphosphate-containing detergent under the same conditions and is shown in Table I.

| | Weight Percent Tripoly/Pyro/Ortho-Phosphate | Weight Percent Glassy Polyphosphate[a] | Builder/ Hardness Ratio[b] | Δb Values - Post Wash Versus Pre-Wash Reading |
|---|---|---|---|---|
| Test A1 | 21.0/2.4/0.6 | 0.0 | 0.4 | −1.9 |
| | 21.0/2.4/0.6 | 0.0 | 0.6 | −1.6 |
| | 21.0 /2.4/0.6 | 0.0 | 0.8 | −1.7 |
| | 21.0/2.4/0.6 | 0.0 | 1.0 | −1.7 |
| Test A2 | 0/20.0/4.0 | 0.0 | 0.4 | −2.7 |
| | 0/20.0/4.0 | 0.0 | 0.6 | −3.5 |
| | 0/20.0/4.0 | 0.0 | 0.8 | −4.9 |
| | 0/20.0/4.0 | 0.0 | 1.0 | −4.3 |
| Test B | 0/20.0/4.0 | 0.0 | 0.7 | −6.0 |
| | 0/20.0/4.0 | 1.0 | 0.7 | −2.6 |

[a]Glassy polyphosphate used was GlassH ® from FMC.
[b]Varied by changing the hardness content of wash solution.

The two builder systems in Test A were tested across a range of builder/hardness ratios from 0.4–1.0. The system in Test A1 (21/2.4/0.6 tripoly/pyro/ortho phosphate) was chosen to examine the UMB redeposition properties of a low level reversion (15%) system typical of high phosphate-built products. The data showed no specific "pyro-dip". The system in Test A2 (0/20/4) represented an extreme point of total reversion of tripolyphosphate to pyro/ortho-phosphate. Results clearly demonstrated the "pyro-dip" phenomenon with poorest results obtained at a builder/hardness ratio of 0.8.

The purpose of Test B was to examine the effect of a low level addition of glassy phosphate to the poorest performing product suggested by Test A. The test, conducted at a builder/hardness ratio of 0.7, clearly showed the benefit obtainable from the inclusion of 1.0% glassy phosphate. However, it was desired to obtain confirmation of this benefit with a more realistic type of soil.

Cotton muslin, polyester/cotton (65/35), and double-knit polyester swatches were soiled with a particulate clay soil (Cincinnati, Ohio origin) by passing the fabrics through an aqueous clay slurry, after which the fabrics were dried by passing through a 2-roll wringer and then through an oven. The swatches were cut to 5½ inches square and three of each fabric type were laundered in an automatic miniature washer at 100° F and various water hardness levels for 10 minutes. Three white cotton terry washcloths were included in each laundering treatment for the purpose of measuring the degree of soil redeposition.

The Base detergent formulation is set out below and was employed in an amount of 6.1 grams/1½ gallons water (equivalent to 0.9 cup/17 gal. water).

| Ingredient | Parts by Weight |
|---|---|
| Linear alkyl benzene sulfonate (average alkyl chain of 11.8) | 14.0 |
| Alkyl ethoxylate sulfate (average alkyl chain of $C_{15}$, average ethoxy Of 3.0) | 6.0 |
| Sodium tripoly/pyro/ortho/phosphate | 11.0/11.0/2.0* |
| Sodium silicate ($SiO_2$:$Na_2O$ ratio of 2.0:1) | 12.0 |
| Sodium sulfate | 36.0 |
| Water | 6.0 |
| Polyethylene glycol | 0.9 |
| Miscellaneous | 1.1 |

*Degree of phosphate reversion encountered under processing conditions necessary to make the product at 6% moisture content.

Pairs of washes were carried out at each of seven different water hardnesses, one wash being in the presence of 1% by weight of the Base detergent of glassy phosphate (added dry to the wash solution) and one wash being in the absence of glassy phosphate. After washing, the cotton terries were dried and the degree of soil redeposition measured in a conventional manner employing a Hunter Color Difference Meter. In this case, since the swatches were being evaluated for whiteness maintenance, the overall Hunter whiteness reading was taken. The lower the value of the whiteness reading the lower the whiteness level (i.e., the greater the soil redeposition via the "pyro-dip"). The effect of the addition of glassy polyphosphate on the "pyro-dip" was determined by comparing the respective Hunter Whiteness values at each water hardness.

Results of the foregoing tests are tabulated in Table II.

Table II

| Detergent Formulation | % Glassy Poly-phosphate* | Water Hard-ness (grains/gal.)** | Hunter Whiteness |
|---|---|---|---|
| Base | 0 | 2 | 109.5 |
| Base | 1.0 | 2 | 111.5 |
| Base | 0 | 4 | 69.5 |
| Base | 1.0 | 4 | 108.0 |
| Base | 0 | 5 | 75.5 |
| Base | 1.0 | 5 | 106.0 |
| Base | 0 | 6 | 80.5 |
| Base | 1.0 | 6 | 107.0 |
| Base | 0 | 7 | 98.0 |
| Base | 1.0 | 7 | 107.0 |
| Base | 0 | 9 | 104.5 |

Table II-continued

| Detergent Formulation | % Glassy Poly-phosphate* | Water Hard-ness (grains/gal.)** | Hunter Whiteness |
|---|---|---|---|
| Base | 1.0 | 9 | 106.0 |
| Base | 0 | 12 | 105.0 |
| Base | 1.0 | 12 | 106.5 |

*Glass H® from FMC
**Calculated as $CaCO_3$

The addition of glassy polyphosphate to a low phosphate detergent provides dramatically improved whiteness maintenance properties in the laundering of textile materials bearing soils encountered under normal soiling conditions. It is also observed that the compositions of the present invention which contain the glassy phosphate have significantly less buildup of surfactant salts and insoluble phosphate salts upon the exposed surfaces of the washing machine drum.

It is further noted that when the builder system is formulated such that there is no tripolyphosphate present i.e. a mixture of orthophosphate and pyrophosphate within aforedescribed ratios that the precipitation of the calcium surfactant as well as the phosphate salts on exposed machine surfaces is very heavy. The glassy phosphates of the present invention are, however, extremely effective in removing both the calcium surfactant (sulfonate and/or sulfate) as well as the phosphate salts from said surfaces.

What is claimed is:

1. A granular detergent composition consisting essentially of:

(A) from about 0.5% to about 2.5% of a glassy phosphate having the general formula $$M_{2y+2}P_{2y}O_{6y+1}$$

wherein M is an alkali metal and $y$ has a value in the range of from about 7 to about 12;

(B) from about 22 to about 28% by weight of the composition of an alkali metal of a phosphate builder mixture comprising:

(i) from about 10 to 15% by weight of the composition of a pyrophosphate-orthophosphate mixture wherein the ratio of pyrophosphate to orthophosphate is in the range of 10:1 to 3:1 by weight, the cations of said salts being selected from the group consisting of hydrogen, alkali metal, ammonium and substituted ammonium cations with at least one of the cations being something other than hydrogen; and (ii) from about 7 to about 18% by weight of the composition of a tripolyphosphate;

(C) from about 15 to about 25% by weight of the composition of an organic surfactant selected from the group consisting of water-soluble $C_{10}$–$C_{20}$ alkyl ether sulfates containing an average of from 1 to 4 ethylene oxide groups, water-soluble $C_{12}$–$C_{20}$ linear alkyl sulfates, and water-soluble $C_{10}$–$C_{14}$ linear alkyl benzene sulfonates and mixtures thereof;

(D) from about 1 to about 15% of sodium silicate having an $SiO_2$:$Na_2O$ ratio of from about 4:1 to about 1.5:1; and (E) from about 5 to about 40% sodium sulfate.

2. A detergent composition according to claim 1 wherein M is sodium or potassium.

3. A detergent composition according to claim 1 wherein the pyrophosphate and orthophosphate are derived from the reversion of tripolyphosphate.

* * * * *